United States Patent [19]

Alley et al.

[11] 3,963,070

[45] June 15, 1976

[54] CONDITION CONTROLLING AIR FLOW DAMPER

[75] Inventors: Raymond L. Alley, Toledo, Ohio; Miguel A. Ordorica, Temperance, Mich.

[73] Assignee: American Warming and Ventilating Inc., Toledo, Ohio

[22] Filed: Feb. 18, 1975

[21] Appl. No.: 550,848

[52] U.S. Cl. ..... 165/98; 165/40; 165/96

[51] Int. Cl.[2] ..... F01P 7/10

[58] Field of Search ..... 165/40, 98, 96, 101, 165/103, 35; 236/35.2; 62/183; 137/625.42

[56] References Cited

UNITED STATES PATENTS

| | | | |
|---|---|---|---|
| 1,820,779 | 8/1931 | Carson | 165/96 |
| 3,122,202 | 2/1964 | Scharres | 165/40 |
| 3,908,751 | 9/1975 | Sheppard | 165/40 |

*Primary Examiner*—Charles J. Myhre
*Assistant Examiner*—Daniel J. O'Connor
*Attorney, Agent, or Firm*—Henry K. Leonard

[57] ABSTRACT

A multi-blade damper for an exhaust duct through which heated air flows after passage through heat exchange coils carrying a hot, liquid heat exchange medium which is subject to solidification if cooled too greatly, for example, sodium. When the heat exchange medium is very hot, air is forced through the duct by high volume fans and the damper blades are opened widely. When the source of heat to the heat exchange medium is shut down, however, the flow of the heat exchange medium and its temperature are greatly reduced. Even if the fans are shut off at this point, the natural draft of air through the duct may so cool the coils of the heat exchanger that the medium will freeze in the coils. Under these conditions, some of the damper blades are closed to majorly reduce the air flow. However, during the transition from hot operating conditions to stand-by conditions and during stand-by periods, the heat exchange medium must be kept hot enough to prevent solidification. The damper, therefore, has some blades which are opened and closed proportionately to the temperature of the medium at all times thus providing a vernier-type control over the air flow through the duct and, therefore, preventing either over-heating or over-cooling of the heat exchange medium. The damper also may be used similarly to control other conditions, such as pressure, rate of flow, combustion conditions, etc., in the duct or in the apparatus from which the air flows through the duct.

19 Claims, 16 Drawing Figures

CONDITION CONTROLLING AIR FLOW DAMPER

BACKGROUND OF THE INVENTION

Multiple blade dampers for air exhaust ducts have been used in many locations where air is to be exhausted from an enclosure. Such a damper can be designed to control the volume of air flowing through the damper as required to control the condition in the enclosure or in the enhaust duct. Most such dampers, however, are able to control only major changes in the volume of air desired to be exhausted. Such dampers, therefore, are not capable of providing control both for major changes and for minor variations in the volume of air to be exhausted to accomplish close control of the condition under consideration.

Air exhaust ducts may be utilized for the discharge of air flowing through the ducts from many different sources, such as heat exchangers, combustion chambers, pressurized enclosures, mechanisms actuated by the flow of air which is finally discharged, etc. As a result it is desirable in many installations to be able to control the flow of air through the duct and thus to control the condition existing in the duct or in the apparatus from which the air flows through the duct.

It is, therefore, the principal object of the instant invention to provide a condition controlling air flow damper which can be adjusted to control major variations in the condition being controlled and also has means for "vernier-type" control of minor variations in the condition being controlled.

Because many of the conditions to be controlled by a damper embodying the invention result in the discharge through the damper of extremely high temperature air, it is yet another important object of the instant invention to provide for contraction and expansion of the elements of the damper, as their temperatures change, in such fashion that the damper functions properly at either extreme of the temperature to which it is subjected during normal operation, during what might be called "stand-by" operation and during transition from one to the other.

A more specific object of the instant invention is to provide an air flow control damper responsive to major changes and with vernier-like movements to provide for control of the temperature of a liquid heat-exchange medium which is subject to solidification if cooled too greatly and which normally operates at extremely high temperature, for example, liquid sodium, utilized as a heat exchange medium in an atomic energy generating plant.

DESCRIPTION OF PREFERRED EMBODIMENT

A damper embodying the invention is generally indicated by the reference number 20 and is illustrated as being positioned across a rectangular duct 21 having end walls 21*a* and 21*b* and side walls 21*c* and 21*d*. The damper 20 consists of three major sections: "A," illustrated particularly in FIGS. 4 and 5; "B," illustrated particularly in FIGS. 9–16 and "C" illustrated particularly in FIGS. 6 and 7. The sections A and C are identical with each other but are arranged in opposed relationship, and the section B is positioned between the two end sections A and C.

Figure 6:
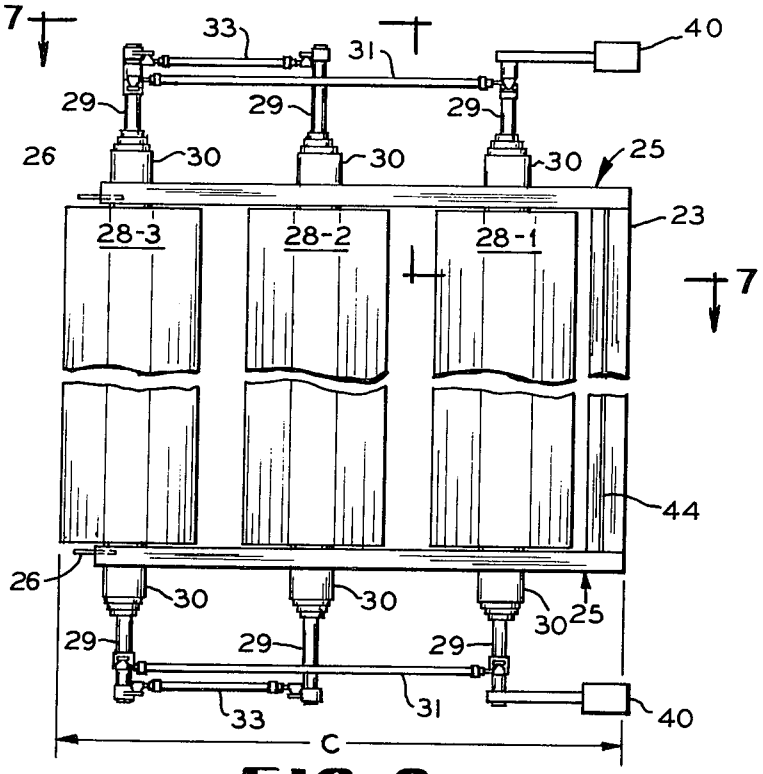
FIG. 6 is a view similar to FIG. 4 but showing another and opposite multiple blade damper section identical in general construction to that shown in FIG. 4 but of reverse "hand"
Figure 7:
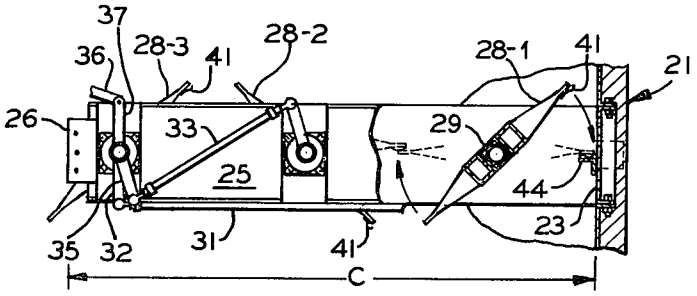
FIG. 7 is a view, partly in elevation and partly in section, taken along the line 7—7 of FIG. 6 and shown on a slightly enlarged scale.

The damper 20 has a main frame comprising end channels 22 on section A (FIGS. 4 and 5) and 23 on section C (FIGS. 6 and 7). The end channels 22 and 23 are welded or otherwise rigidly connected to side channels 24 on section A and side channels 25 on section C. The inner-ends of the side channels 24 and 25 mount rectangular gusset plates 26 by which the end sections A and C are connected to the center section B, the gusset plates 26 being bolted to side channels 27 of the center section B.

Figure 4:
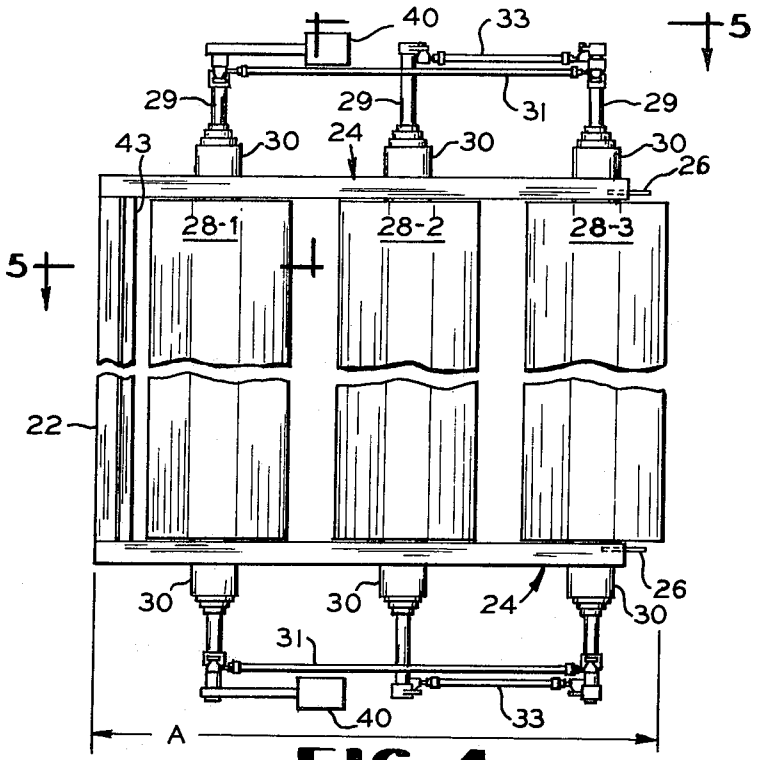
FIG. 4 is a fragmentary plan view of one of a pair of multiple blade damper sections according to the invention for the major control of the condition involved.
Figure 5:
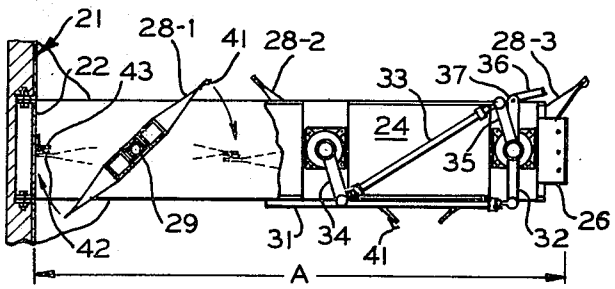
FIG. 5 is a fragmentary view, partly in section and partly in elevation, taken generally from the position indicated by the line 5—5 of FIG. 4 and shown on a slightly enlarged scale.
Figure 8:
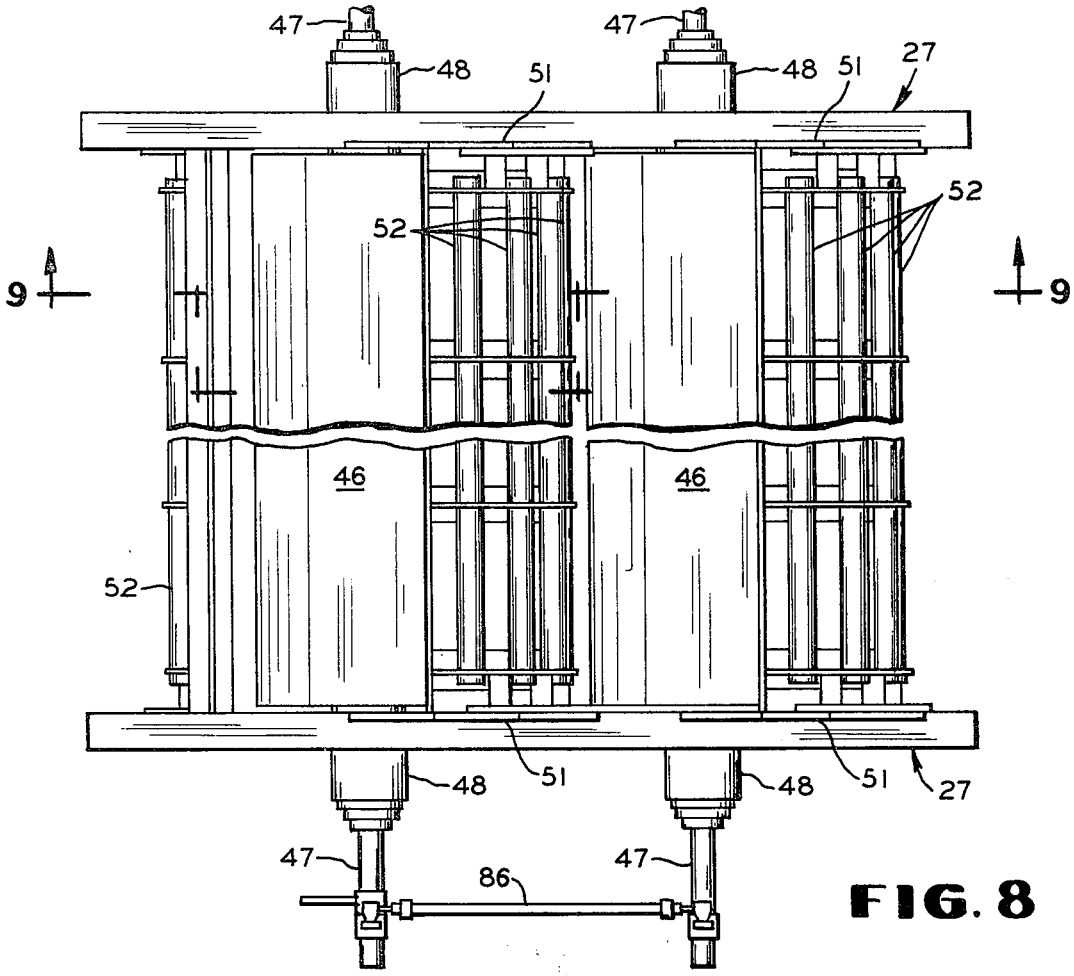
FIG. 8 is a fragmentary plan view of another section of a damper emobodying the invention as specifically designed for the vernier-like control of the condition under consideration.

Each of the sections A and C comprises three rectangular damper blades 28 indicated as 28-1, 28-2, and 28-3 in FIGS. 4 and 6. Each of the blades 28 is carried by a shaft 29 and each of the shafts 29 is rotatably mounted in journals 30 which are fixed to the outer sides of the side channels 24 or 25, as the case may be. A connecting link 31 extends between two arms 32, one of which is mounted on each end of the shaft 29 for each of the damper blades 28-1, and 28-3. Similarly, a link 33 is pivotally connected at its opposite ends to arms 34 on the shafts 29 of blades 28-2 and arms 35 on the shafts 29 for blades 28-3. Operating links 36 are pivotally connected to arms 37 that also are secured on the shafts 29 of the inner-blades 23-3 and connected at their inner ends to a lever 38 on an actuator generally indicated by the reference number 39. Weights 40 also are fixed on the ends of the shafts 29 of the outermost blades 28-1 in each case. By this arrangement of links 31, 33 and 36, the blades 28-1 and 28-3 move in the same directions together, and the blades 28-2 move in opposite directions. However, all six of the blades in the two damper sections A and C simultaneously move between "open" and "closed" positions.

A blade seal 41 is mounted on and extends along one edge of each of the blades 28 and a similar seal 42 is mounted on a crossbar 43 of the end channel 22 of the damper section A. A crossbar 44 is similarly, though oppositely, mounted on and extends across the end channel 23 of the damper section C. By reason of the relative positions of the actuating arms of the various damper blades 28, the blades 28-2 are swung to fully closed position (see dotted lines indications in FIGS. 5 and 7) slightly ahead of the end blades 28-1 and 28-3 so that the seals 41 are engaged by the opposite edges of adjacent blades 28 in sequence, in order fully to cut off the flow of air through the damper sections A and C.

The actuator 39 is so connected with and responsive to the condition of the apparatus involved in any particular installation, as to provide for desired major control. In the embodiment of the invention illustrated, as positioned in the exhaust duct of the sodium heat exchanger, the actuator 39 is so adjusted as to hold the major control blades 28 at the position to provide for the flow of a proper volume of air during normal operation of the atomic pile. During transition toward standby or during standby, depending upon the residual heat in the reactor, the volume of air flow due to natural draft, whether or not auxiliary heat is being applied to the sodium loop, etc., major control over the air flow and the resulting condition within the duct 21 and the apparatus, may also require setting the major control blades 28 at different particular positions. In addition, particularly for testing and experimental purposes, the actuator 39 also has a hand wheel 45. In the event of failure of a control signal to the actuator 39, the weights 40 are heavy enough to close the blades 28 of the Sections A and C.

Damper Section B is particularly shown in FIGS. 8–16, inclusive, and is designed and utilized for the purposes of applying vernier-like control, particularly during transitional periods from operative to stand-by conditions and during stand-by conditions. In the embodiment of the invention disclosed as utilized in the exhaust stack of an atomic energy generating plant, the effective minor control of air flow is determined by the temperature of the liquid sodium in the heat exchanger serviced by the exhaust duct. Testing has revealed that the damper embodying the invention can achieve control within plus or minus 2% of the desired temperature of the sodium in the heat exchange loop under stand-by conditions.

Figure 1:
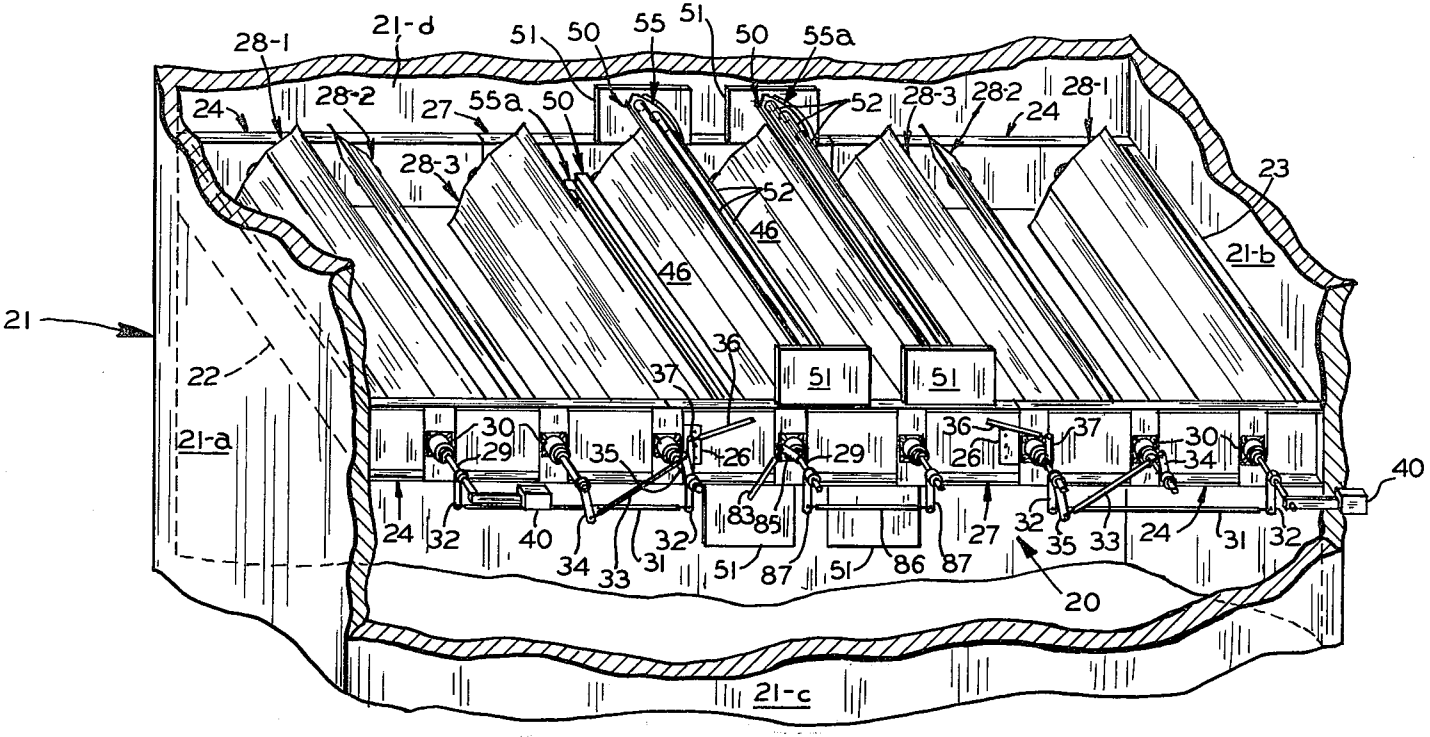
FIG. 1 is a simplified view in perspective of a damper embodying the invention, many details being omitted and including a fragmentary showing of an exhaust duct in which the damper is installed.
Figure 2:
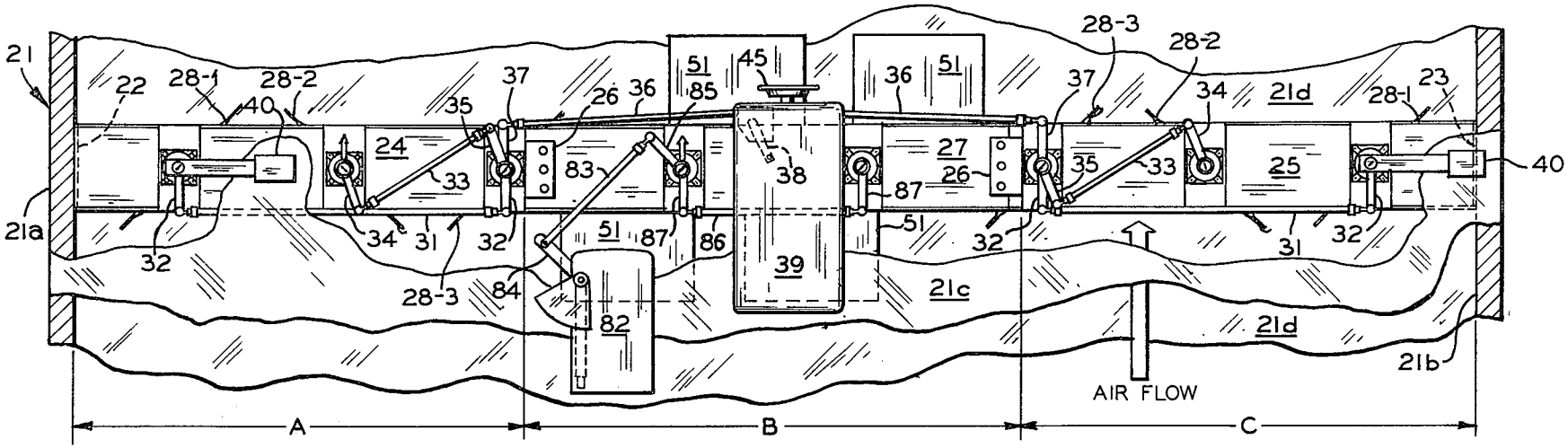
FIG. 2 is a side view in elevation of the damper taken generally from the position indicated by the line 2—2 of FIG. 1.
Figure 3:
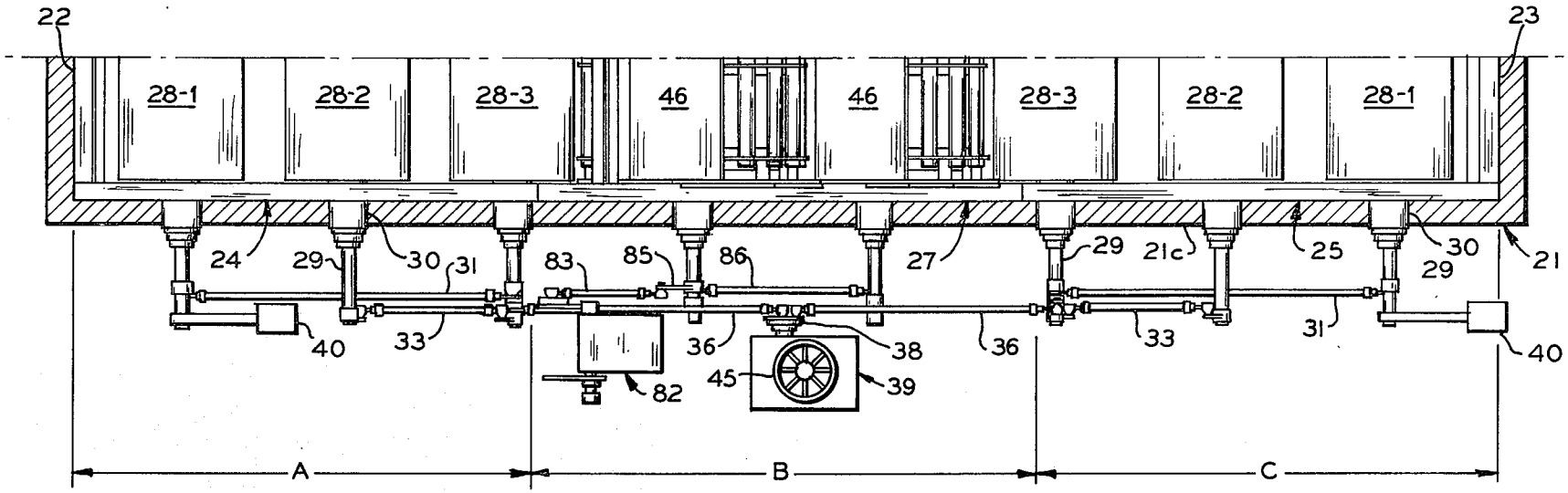
FIG. 3 is a half-plan view of the damper, being shown on the same scale as FIG. 2 and aligned therewith for ready comparison.

Damper Section B in the disclosed embodiment comprises two damper blades 46 which are identical in construction with the damper blades 28 of Sections A and C and, similarly, are mounted on parallel, transversely extending shafts 47 which are rotatably mounted in journals 48 on the side channels 27. The side channels 27 of the Section B are connected to side channels 24 and 25, respectively, of the Sections A and C by heavy bolts or similar elements (not shown) inserted through holes 49 at the ends of the side channels 27 and through the gusset plates 26 previously described. After this assembly, the main frame of the damper 20 is rigidly constructed and spans the entire duct 21, being mounted by structural elements, not shown, on the end walls **21*a* and 21*b* (FIGS. 1–3) and the side walls 21*c* and 21*d* of the duct 21.**

Each of the blades 46 has a pair of curved baffles 50, all of which are substantially identical in construction and which are arranged in opposed relationship to their respective blades 46. Each of the baffles 50 consists of three aligned portions extending across between the side channels 27 and indicated by the brackets and reference numbers **50*a*, 50*b*, and 50*c* in FIG. 10.**

Each of the baffles 50, as a unit, extends across the damper 20 between side channels 27 and heavy support plates 51 which are welded to and extend upwardly or downwardly from the side channels 27 at each side of the damper 20. The baffles 50 are carried by transversely extending support tubes 52, four being shown for each baffle 50, the tubes extending through holes 53 in legs 54 of curved T-bars 55. The tubes 52 are welded to each of the several T-bars 55 through which they extend, there being seven of the T-bars 55 for each of the baffles 50 in the embodiment of the invention illustrated. Each of the T-bars 55 has a curved cross arm 56 rigidly welded to its leg 54, the cross arms 56 providing the formed surfaces against which the sheet metal of the baffle 50 is retained.

As can best be seen by reference to FIGS. 11–13 and 16, each of the T-bars 55 is positioned between a plurality of resilient clips 57 which have spacing arms 58 and retaining arms 59. The individual clips 57 are held in frictional contact against the cross arms 56 by nuts 60 threaded onto studs 61 which are, in turn, welded to the back sides of the plates making up the baffles 50. A guide bar 62 also is welded to the back surface of the baffle 50 closely adjacent each of the spacing arms 58 in order to prevent the clips 57 from turning on their respective studs 61.

As mentioned above, each of the baffles 50 consists of three individual sections **50*a*, 50*b* and 50*c*. Those T-bars 55 which are positioned at the mid-points of each of the baffle sections 50*a*, 50*b*, and 50*c* are tightly embraced by their retaining studs 51 (FIG. 11) so that the center of the respective section of the baffle 50 is held against movement longitudinally of the support tubes 52, i.e., expansion or contraction of the metal of the baffle section transversely across the baffle 20. Conversely, those T-bars 55 which span a space between the adjacent ends of baffle sections (see FIG. 13) are not tightly embraced by their retaining studs 61 so that as the baffle sections expand and contract longitudinally of the support tubes 52, the clips 57 and the baffle sections may move toward and away from each other with the retaining arms 59 of the clips 57 sliding on the back surfaces of the T-bar arms 56. Similarly, in order to accomodate expansion and contraction of the baffles around the curves provided by the T-bars 55, the clips 57 can slide longitudinally relative to the T-bars 55 and their arms 56, i.e., in directions generally normal to the longitudinal extent of the support tubes 52.**

While the mounting structures for all of the baffles 50 are substantially identical, because heated air is flowing through the damper, the inner or "hot" side of the damper is subjected to greater temperature differentials than the outer or "cold" side. Therefore, certain structural elements on the hot and cold sides are different in detail, as will be discussed below.

Figure 10:
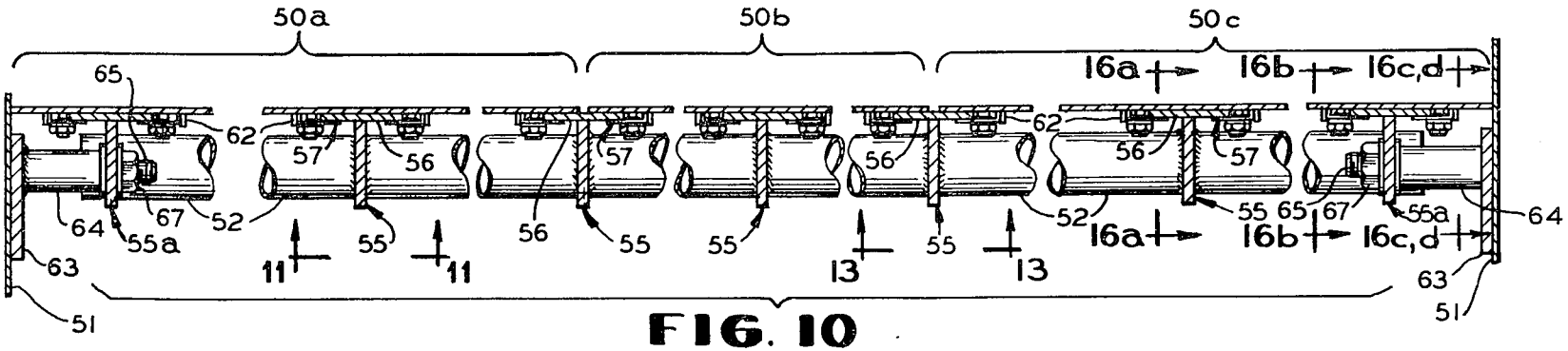
FIG. 10 is a fragmentary view in cross section taken along the line 10—10 of FIG. 9.
Figure 13:
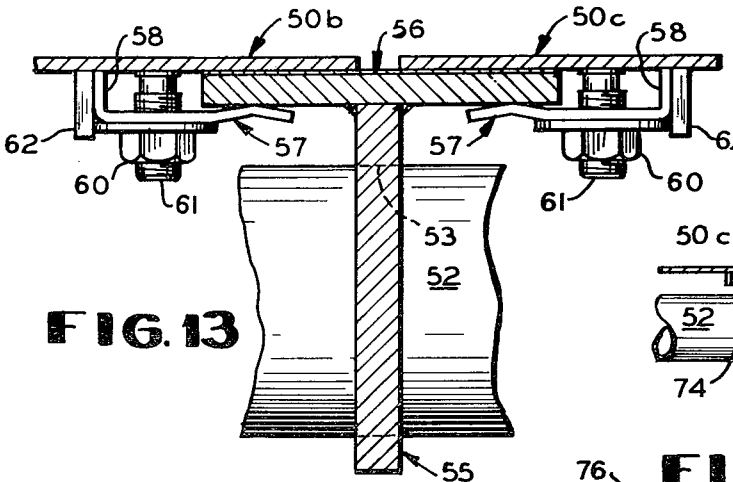
FIG. 13 is a view similar to FIG. 11 but showing that portion of FIG. 10 indicated by the line 13—13 of FIG. 10.
Figure 14:
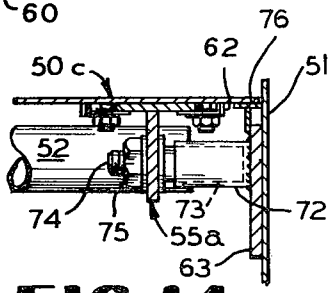
FIG. 14 is a fragmentary view in cross section similar to the right end of FIG. 10 but taken from the position indicated by the line 14—14 of FIG. 9.

Although all of the T-bars 55 are substantially identical to each other, the two end T-bars 55 of each of the baffles 50, indicated by the reference numbers 55*a* in FIG. 10, also are provided with means whereby the entire structure comprising the T-bars 55 their support tubes 52 and their baffle 50 is mounted in the damper 20. This support structure comprises a mounting plate 63 (see also FIG. 16) at each end of each of the baffles 50. Except for the special situation discussed below, as illustrated in FIG. 14, four spacers 64 are welded to the inner side of each of the mounting plates 63 and have reduced diameter threaded ends 65 which extend through holes 66 in the end T-bars 55*a*. Nuts 67 are threaded onto the ends 65 of the spacers 64 for securing the end T-bars 55*a* and thus the entire individual baffle mounting structure to the mounting plates 63.

Figure 16:
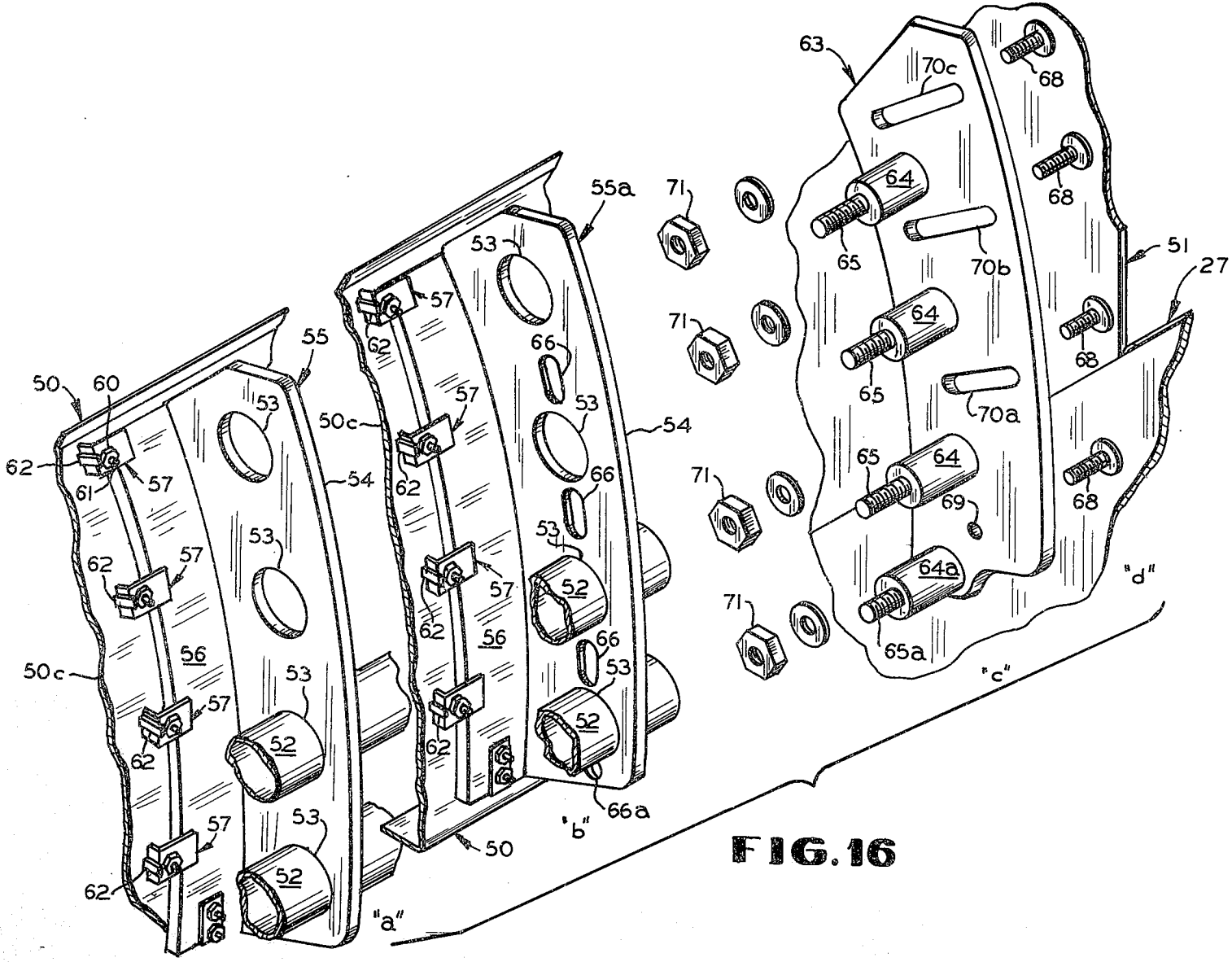
FIG. 16 is a fragmentary, exploded view in perspective, having four parts "a," "b," "c" and "d," taken, respectively, from the positions indicated by the lines 16*a*—16*a*, 16*b*—16*b*, and 16*c*, *d*—16*c*, *d* of FIG. 10.

FIG. 16 also illustrates the provisions for longitudinal expansion and contraction of the T-bars 55, themselves, relative to their major mounting plates 63. The holes 66 in the end T-bars 55*a* consist of a lowermost circular hole indicated by the reference number 66*a*, and three elongated curved holes indicated by the reference numbers 66. The threaded end 65*a* of the lowermost spacer, indicated by the reference number 64*a* in FIG. 16, extends through the circular, lowermost hole 66*a*. When its nut 67 is tightened in place, the entire structure comprising the T-bars 55 and the elements carried thereby can move relative to the mounting plates 63 as the T-bars expand and contract longitudinally, the other spacer ends 65 sliding in their respective elongated holes 66.

Figure 9:
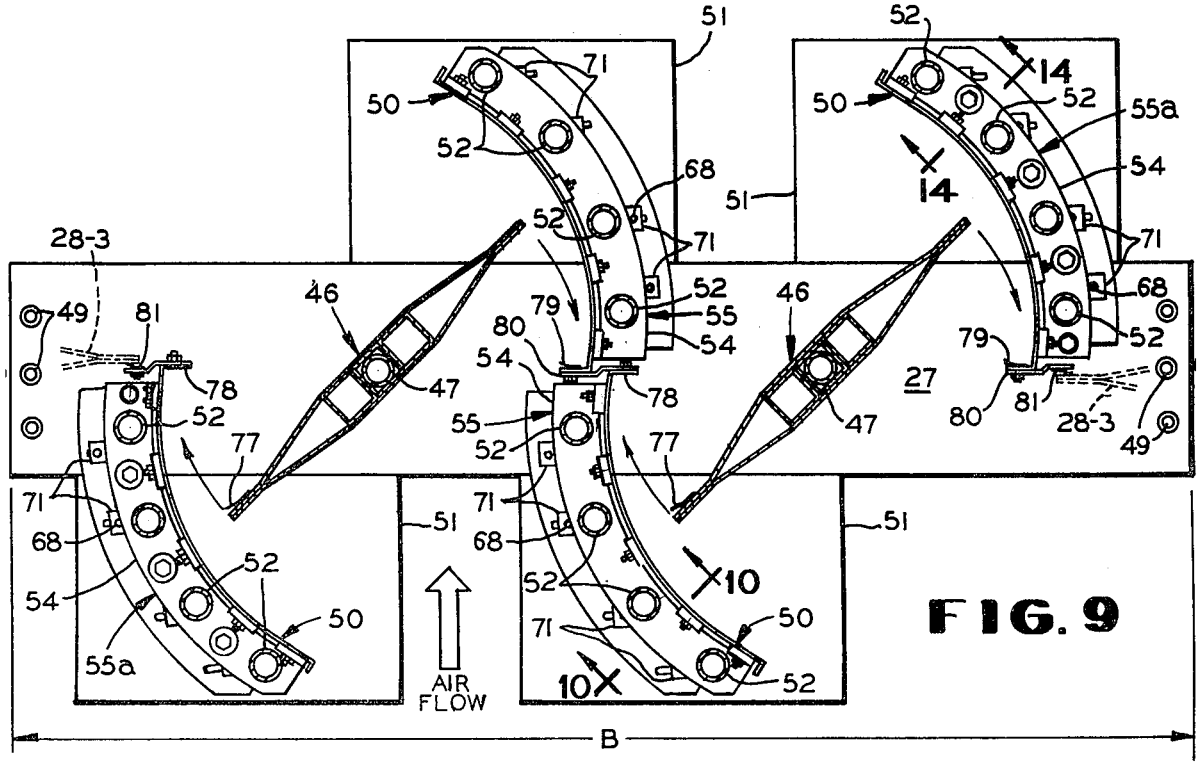
FIG. 9 is a vertical sectional view taken along the line 9—9 of FIG. 8 and shown on an enlarged scale.

Mounting studs 68 are welded to the inner faces of the side channels 27 and the support plates 51. That one of those studs 68 which is welded to the side channel 27 extends through a hole 69 in the mounting plate 63 and each of the other studs 68 which are welded to the support plates 51 extends through an arcuate slot 70*a*, 70*b*, or 70*c*, as the case may be, each of the successive slots having a greater arcuate extent than the preceeding slot. Retaining nuts 71 are threaded onto the studs 68 to mount the plates 63 and the structure supported thereby in the damper 20. The stud 68 which extends through the hole 69 in the plate 63 acts as a pivot point around which the entire baffle 50 and its support structure may be swung with the other studs 68 sliding in their respective slots 70*a*, 70*b* and 70*c*, in order precisely to adjust the degree of divergence between the adjacent edge of the damper blade 46 and its baffle 50, i.e., the distance between the arcuate arrows indicating the paths of travel of the edges of the damper blades 46 and the baffles 50 as shown in FIG. 9. After this adjustment, all of the nuts 71 are tightened securely on their respective studs 68 and the structure thus is rigidly mounted in damper Section B. If desired, the mounting plates 63 may be welded to the side channels 27 and support plates 51 after the adjustments have been completed.

By the structure so far described, the baffle sections 50*a*, 50*b* and 50*c* may expand and contract as their temperatures change, moving longitudinally relative to the support tubes 52 (FIG. 13) and the baffle sections also may expand and contract longitudinally relative to the T-bars 55. Both of these relative movements between the T-bars 55 and the sections of the damper 50 are made possible by the frictional retaining clips 57.

Because the T-bars 55 are made into a unitary structure by reason of their being welded to the support tubes 52, this structure may expand transversely of the damper 20 relative to the baffle 50 and, because of their differing masses, such relative movements take place as the structure changes its temperature. By reason of the rigid mounting of the support tubes 52 to the T-bars 55 and the end T-bars 55*a* to the mounting plates 63, the support tubes 52 on the hot side also function to push the side channels 27 outwardly as the temperature of the support tubes 52 and the baffles 50 rises so as to provide additional space between the side channels 27 to accomodate the damper blades 46 which also expand longitudinally of their shafts 47 as their temperature increases. Conversely, if the temperature of these structures drops, all of them contract at varying degrees by reason of their differing coefficients of expansion, and the mounting so far described provides for this movement as well.

However, because the hot side of the damper 20, i.e., the lower portion in FIG. 9, is subjected to more extreme variations in temperature than is the cold side, i.e., the upper baffles 50 as shown in FIG. 9, there results a different relative expansion and contraction. Provision for differential expansion and contraction between the hot sides of the baffles 50 and their cold sides is illustrated in FIG. 14. Instead of mounting the end T-bars 55*a* rigidly on studs 64, as is the case with the baffles 50 on the hot side of the damper 20, the end T-bars 55*a* on the cold side are mounted for movement relative to the mounting plates 63 in a direction longitudinal of the support tubes 52. In these outer positions of each of the end T-bars 55*a*, where spacers 64 would otherwise be present, a short socket 72 is welded to the mounting plate 63 in line to receive a pin 73. The pin 73 has a reduced diameter threaded end 74, which extends through the respective one of the holes 66 and a heavy nut 75 is threaded on the end 74. The pin 73 and its socket 72 hold the structure in place at the cold side but they also provide for relative movement between the cold end of the baffle 50 and its mounting plate 63.

Figure 15:
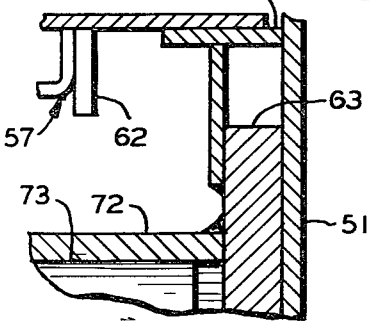
FIG. 15 is a greatly enlarged detailed view of a part of FIG. 14.
Figure 11:
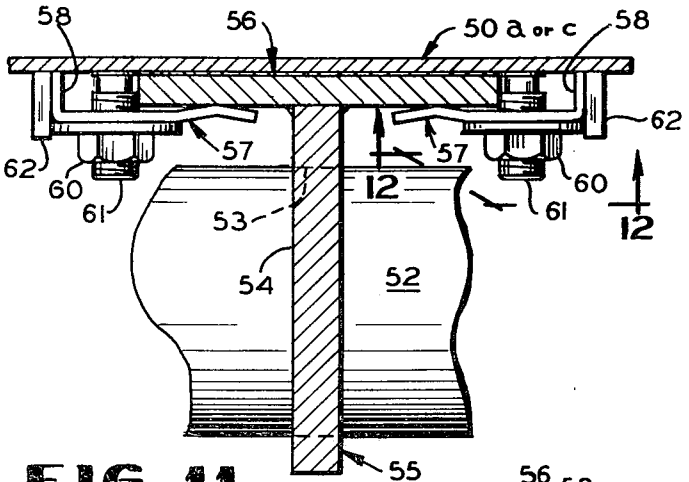
FIG. 11 is a fragmentary sectional view on an enlarged scale, showing that portion of FIG. 10 indicated by the line 11—11 of FIG. 10.
Figure 12:
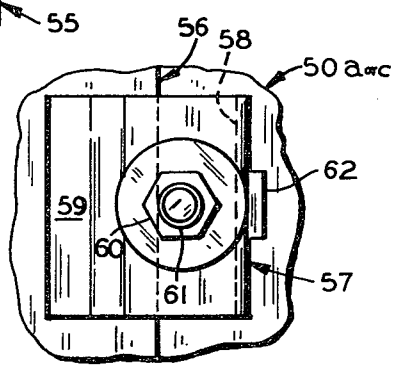
FIG. 12 is a fragmentary view in elevation taken from the position indicated by the line 12—12 of FIG. 11.

Similarly, as is illustrated in FIG. 15, at this cold side, the edge of the damper section 50*c* rests against an arcuate ledge 76 welded to the mounting plate 63.

As is the case with the damper blades 28 of damper Sections A and C, the blades 46 of damper Section B have edge sealing means. Each of the two blades 46 has a resilient blade seal 77 on its "up stream" edge (FIG. 9) which engages a lip 78 at the edge of its baffle 50. Similarly, the opposite edges of the blades 46 close against edge seals 79 which are mounted on lips 80 on the down stream baffles 50 for each respective blade 46. In addition, the lip 78 of the baffle 50 adjacent the damper section A and the lip 80 on the baffle 50 adjacent the damper Section C, mount edge seals 81 which are engaged by the edges of damper blades 28-3 of the damper Sections A and C, respectively, when the blades 28-3 are swung to closed position.

During normal operation of the atomic pile, i.e., when the sodium is being pumped under operating conditions through the atomic pile and then through the heat exchanger in the cooling duct 20, the high speed fans (not shown) are exhausting air through the duct 20 in high volume. The major control damper blades 28 and the minor variation vernier-like damper blades 46 are both held open by their control actuators 39 or 82, FIGS. 2 and 3. The actuator 82 is connected to the two damper blades 46 through the medium of a link 83 connected between an actuator arm 84 and a blade arm 85. The arm 85 is fixed on the shaft 47 of one of the blades 46 and the two blades 46 are connected to each other for simultaneous movement by a link 86 connected between arms 87 which are fixed on the two shafts 47 of the damper blades 46.

As briefly explained above, when the pile is shut down it is nevertheless essential to so control the flow of air through the duct 20 as to maintain the sodium in the closed loop in a liquid condition. In such an installation, there is a certain flow of air through the duct 20 by reason of the natural draft, i.e., simply by convection. However, of course, the volume of air flowing by natural draft and its temperature varies according to atmospheric conditions. Thus it is possible that even if the fans are shut down, air flow through the duct 20 may be sufficient to excessively cool the sodium in the heat exchanger, perhaps even to such a degree that it will solidify. Under some conditions it may be necessary to inhibit the natural draft through the damper 20. During the transition from operative to stand-by conditions, there may be sufficient residual heat in the sodium as to require that some of the fans operate in order to supply sufficient cooling air to reduce temperature to that above solidification, but to carry away unnecessary heat. Under other conditions, after any residual heat in the pile and in the sodium has been dissipated, it may be necessary to apply auxiliary heat to the closed loop containing the sodium in order to prevent its solidification.

Under the varying conditions resulting from changes in atmospheric conditions, residual heat in the pile during transition from operation to stand-by, application of necessary auxiliary heat or minor fan operation, etc., it is essential that the temperature of the sodium in the closed loop be kept as cool as possible and yet not be allowed to cool sufficiently so that it solidifies.

For the various reasons mentioned, the actuator 82, which moves the vernier-like damper blades 46 between fully open and fully closed positions, and to and from intermediate positions, is made responsive to the temperature of the sodium at the heat exchanger located in the duct 20. When the pile is operating and the sodium is very hot when it reaches this heat exchanger, (not shown) the actuator 82 opens the damper blades 46 fully so as to provide for complete exhaust of all of the cooling air from the exhaust fans through the duct 20. The main or major variation blades 28 also are kept open by their actuator 39 at this time. When the conditions are other than normal operation of the pile, and the exhaust fans are shut down, the actuator 39 closes the blades 28. However, if the actuator 39 fails to receive its control signal the weights 40 close the blades 28. Under these conditions, either to control the normal draft, i.e., convection flow through the damper 20, or to compensate for the presence of residual heat, auxiliary heat, minor air flow, etc., the actuator 82 swings the damper blades 46 to a position so selected that the flow of cooling air through the duct 20 keeps the sodium in the desired temperature range.

In an installation such as that described, indeed, it has been determined by tests that a damper according to the invention can keep the sodium temperature within plus or minus 2° of the desired temperature. This is particularly surprising when it is realized that a damper for the purpose described in an atomic energy generating plant may be as large as 24 feet long by 12 feed wide, with each individual damper blade weighing as much as approximately 1,000 pounds. Such a damper may be employed for controlling air flow varying in volume from only a relatively few cubic feet per minute to as much as 1 million cubic feet per minute.

While the invention has been described in detail as it is installed in the exhaust duct of an atomic energy plant, the provision for major and minor variation control and modulation of the minimum air flow through the damper, also has utility in many other installations. For examples, it may be desired to control the air flow through the damper not only at a maximum and a minimum but also, say, at 50%. The outboard damper Sections A and C can be preset to provide for the flow of 50% of the maximum air through the damper at a given pressure and the center Section B modulated to control the flow within plus or minus 1 or 2 percent around the 50% figure. Not only volume of air flow through the duct may thus be controlled but also air pressure within the duct may be controlled in such fashion. For these various reasons, while a specific embodiment has been disclosed, the damper embodying the invention is not to be restricted beyond the scope of the sub-joined claims.

Having described our invention, we claim:

1. A multi-blade control damper for a duct through which there flows a varying volume of air for the control of a condition in the duct, said damper comprising a. a frame, b. at least one first blade extending across said frame and pivotally mounted therein for movement on an axis extending across said frame, between closed and open positions, c. means for moving said first blade to adjust for major changes in the condition to be controlled, d. at least one second blade extending across another portion of said frame and pivotally mounted therein for movement on an axis extending across said frame between closed position and open position, e. at least one baffle mounted in and extending across said frame parallel to the axis of said second blade,

1. a first edge of said baffle that is adjacent the edge of said second blade when in closed position being spaced from the axis of said second blade a distance substantially equal to the width of said second blade between the axis and that edge thereof,

2. an opposite edge of said baffle being spaced from the axis of said blade a greater distance than the said first edge of said baffle, and f. means for moving said second blade between closed and open positions and to positions therebetween by which movements the changes in the opening between the edge of said blade and said baffle are proportional to minor changes in the condition to be controlled.

2. A damper according to claim 1 and means for varying the spacing between the edge of the second blade and the baffle.

3. A damper according to claim 1 in which there are more than one first damper blade and all of said first damper blades are interconnected for simultaneous and similar movement to and from open and closed positions.

4. A damper according to claim 1 and means biasing the first damper blade toward pre-selected position.

5. A damper according to claim 1 in which the condition to be controlled is a temperature in the interior of the duct.

6. A damper according to claim 1 in which the duct carries cooling air over a heat exchanger and the means for moving the second blade is responsive to minor variations in the temperature of the medium in the heat exchanger.

7. A damper according to claim 6 in which the condition to be controlled is the temperature of a heat exchange medium in a heat exchanger located in the duct ahead of the damper and the means for moving the second blade is responsive to minor variations in the temperature of the medium in the heat exchanger.

8. A damper according to claim 1 in which the frame of the damper is rectangular and the axes of the first and second blades are parallel to the ends of said frame.

9. A damper according to claim 1 in which the baffle is curved.

10. A damper according to claim 1 in which the baffle is mounted by support structure providing for relative movement between said baffle and said structure as said baffle expands and contracts in response to changes in the temperature thereof.

11. A damper according to claim 10 in which the support structure comprises (a) a support member extending across said frame parallel to the axis of the second blade, (b) curved elements carried by said member and supporting the baffle and (c) means providing for relative movement between the baffle and the support member due to relative expansion and contraction of such structure and the parts thereof.

12. A damper according to claim 10 in which both ends of the support member are fixed to the frame.

13. A damper according to claim 10 in which one end of the support member is fixed to the frame and the other end thereof is slidingly mounted to the frame.

14. A damper according to claim 10 and means including a baffle support structure for mounting said baffle in the frame, said structure comprising (a) a support member extending across said frame parallel to the axis of the second blade, (b) curved elements carried by said member and lying in sapced planes normal to the axis of said second blades and (c) retainers slidingly mounting said baffle on said elements for movement of said baffle and parts thereof in directions parallel to and normal to the axis of said second blade due to expansion resulting from heat transferred thereto by the air flowing through said damper.

15. A damper according to claim 14 in which the curved elements are fixed on the cross member, and mounting means for said elements including means providing for expansion and contraction of said elements relative to said mounting means.

16. A damper according to claim 14 in which the baffle consists of at least two similarly curved sheets of metal positioned in end-to-end relationship across the frame and the support structure includes means fixing the center portions of said sheets to the cross member against longitudinal movement thereof and means retaining the inner ends thereof for movement resulting from expansion and contraction of said sheets in response to changes in the temperature thereof.

17. A multi-blade damper for a duct through which there flows cooling air from a heat exchange coil containing a hot, liquid, heat exchange medium, said damper comprising a. a rectangular frame, b. at least one first rectangular blade extending across said frame and pivotally mounted therein for movement from closed position to open position, c. means responsive to the temperature of the heat exchange medium for moving said first blade, d. at least one second rectangular blade extending across another portion of said frame and pivotally mounted therein for movement on an axis parallel to its edge between closed position and open position, e. at least one curved baffle mounted in and extending across said frame generally parallel to the axis of said second blade.

1. a first edge of said baffle that is adjacent the edge of said second blade when in closed position, being spaced from the axis of said second blade a distance substantially equal to the width of said second blade between the axis and the edge thereof, and 2. an opposite edge of said baffle being spaced from the axis of said blade a greater distance than said first edge of said baffle, and f. means responsive to minor variations in the temperature of the heat exchange medium for moving said second blade between closed and open positions and to positions therebetween by which movements the changes in the opening between the edge of said blade and said baffle are proportional to minor changes in the temperature of the heat exchange medium for maintaining such temperature within a limited range.

18. A damper according to claim 17 in which the baffle is mounted on curved supports, the curved supports are fixed to the cross-members and the structure comprising the baffle, the curved supports and the cross-members is mounted in the rectangular frame for angular adjustment for varying the spacing between the opposite edge of said baffle and the axis of the associated one of said blades.

19. A damper according to claim 17 in which the baffle is mounted in the frame by mounting structure comprising means providing for expansion and contraction of said baffle and said mounting structure relative to each other and to said frame.

* * * * *